US009546468B2

(12) United States Patent
Bang

(10) Patent No.: US 9,546,468 B2
(45) Date of Patent: Jan. 17, 2017

(54) HYDRAULIC SYSTEM OF CONSTRUCTION MACHINE

(71) Applicant: DOOSAN INFRACORE CO., LTD., Incheon (KR)

(72) Inventor: Jai Seok Bang, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 322 days.

(21) Appl. No.: 14/360,504

(22) PCT Filed: Dec. 24, 2012

(86) PCT No.: PCT/KR2012/011356

§ 371 (c)(1),
(2) Date: May 23, 2014

(87) PCT Pub. No.: WO2013/100511

PCT Pub. Date: Jul. 4, 2013

(65) Prior Publication Data

US 2014/0366518 A1 Dec. 18, 2014

(30) Foreign Application Priority Data

Dec. 27, 2011 (KR) ..... 10-2011-0143066
Dec. 18, 2012 (KR) ..... 10-2012-0148200

(51) Int. Cl.
*F16D 31/02* (2006.01)
*E02F 9/22* (2006.01)
(Continued)

(52) U.S. Cl.
CPC ..... *E02F 9/2235* (2013.01); *E02F 9/2285* (2013.01); *E02F 9/2292* (2013.01); *E02F 9/2296* (2013.01);
(Continued)

(58) Field of Classification Search
CPC ..... F15B 11/165; F15B 11/167; E02F 9/2232; E02F 9/2235; E02F 9/2285; E02F 9/2292; E02F 9/2296
See application file for complete search history.

(56) References Cited

U.S. PATENT DOCUMENTS 5,052,179 A * 10/1991 Fujii ..... E02F 9/2296 60/421
5,907,951 A * 6/1999 Toyooka ..... E02F 9/2232 60/444
(Continued)

FOREIGN PATENT DOCUMENTS

CN 102011416 A 4/2011
JP 2005-060970 3/2005
(Continued)

OTHER PUBLICATIONS

Chinese Office Action mailed Jun. 24, 2015 for Chinese Application No. 201280064522.7, 4 pages.
(Continued)

*Primary Examiner* — Michael Leslie
(74) *Attorney, Agent, or Firm* — John D. Veldhuis-Kroeze; Westman, Champlin & Koehler, P.A.

(57) ABSTRACT

The present disclosure relates to a hydraulic system of a construction machine. The hydraulic system of the construction machine includes: an electronic proportional pressure reducing valve configured to control a flow rate, to which a maximum pressure is input as a control current value, and which is set to a minimum flow rate; a gear pump configured to provide pilot operation oil to the EPPRV; a shuttle valve configured to compare a pressure of first pilot operation oil passing through the EPPRV and a pressure of a flow rate control signal, and output second pilot operation oil having the greater pressure; a hydraulic pump of which a swash plate angle is controlled by the second pilot operation oil;
(Continued)

and a pump control device configured to control a pressure of the EPPRV to be decreased from a maximum pressure by a predetermined inclination when the flow rate control signal is generated.

3 Claims, 7 Drawing Sheets

(51) Int. Cl.

| | |
|---|---|
| ***F15B 13/042*** | (2006.01) |
| ***F15B 11/16*** | (2006.01) |
| ***F15B 11/042*** | (2006.01) |
| ***F15B 11/17*** | (2006.01) |

(52) U.S. Cl.
CPC ..... *F15B 11/0423* (2013.01); *F15B 11/165* (2013.01); *F15B 11/167* (2013.01); *F15B 11/17* (2013.01); *F15B 13/0426* (2013.01); *F15B 2211/20523* (2013.01); *F15B 2211/20553* (2013.01); *F15B 2211/20576* (2013.01); *F15B 2211/3052* (2013.01); *F15B 2211/50554* (2013.01); *F15B 2211/513* (2013.01); *F15B 2211/526* (2013.01); *F15B 2211/633* (2013.01); *F15B 2211/6355* (2013.01); *F15B 2211/6652* (2013.01); *F15B 2211/6654* (2013.01); *F15B 2211/6655* (2013.01); *F15B 2211/6658* (2013.01); *F15B 2211/7142* (2013.01); *F15B 2211/8606* (2013.01); *F15B 2211/8613* (2013.01)

(56) References Cited

U.S. PATENT DOCUMENTS

| | | | | |
|---|---|---|---|---|
| 8,707,690 | B2 * | 4/2014 | Cho | E02F 9/2235 60/444 |
| 2011/0276212 | A1 * | 11/2011 | Wu | E02F 9/2235 701/22 |

FOREIGN PATENT DOCUMENTS

| | | |
|---|---|---|
| JP | 2008-196565 | 8/2008 |
| JP | 2009-249875 | 10/2009 |
| JP | 2010-174980 | 8/2010 |
| JP | 2010-230133 | 10/2010 |

OTHER PUBLICATIONS

"Booklet with Explanatory Diagrams for Repair of Excavator", with English translation, Edited by Li Hong—Nanjing, Jiangsu Science and Technology Press, Jan. 2008 (Library of Repair of Construction Machinery) ISBN 978-7-5345-5740-8.

Search Report dated Mar. 11, 2013 and written in Korean with English translation for International Patent Application No. PCT/KR2012/011356 filed Dec. 24, 2012, 5 pages.

* cited by examiner

--Prior Art--

--Prior Art--

--Prior Art--

--Prior Art--

HYDRAULIC SYSTEM OF CONSTRUCTION MACHINE

CROSS-REFERENCE TO RELATED APPLICATION

This Application is a Section 371 National Stage Application of International Application No. PCT/KR2012/011356, filed Dec. 24, 2012 and published, not in English, as WO 2013/100511 on Jul. 4, 2013.

FIELD OF THE DISCLOSURE

The present disclosure relates to a hydraulic system of a construction machine, and more particularly, to a hydraulic system of a construction machine, which reduces excessive fuel consumption and improves fuel efficiency and manipulability when a worker suddenly operates a joystick in a hydraulic system of a construction machine including a mechanical hydraulic pump.

BACKGROUND OF THE DISCLOSURE

In general, a hydraulic system discharges operation oil from a hydraulic pump, and the operation oil stands by at an inlet of a main control valve. A plurality of spools is provided inside the main control valve, and a plurality of actuators is connected to the outside of the main control valve. Further, pilot pressure, which is a flow rate control signal, is generated in a flow rate demanding unit, such as a joystick and a pedal, and the pilot pressure is provided to the main control valve. In the main control valve, a specific spool is opened/closed by the pilot pressure, and the operation oil is provided to an actuator connected to the corresponding spool by an opening/closing operation of the corresponding spool.

That is, the operation oil discharged from the hydraulic pump is provided to the actuator via the main control valve according to an operation of the joystick, and thus the actuator is operated.

In the meantime, the hydraulic pump receives power from an engine, and the engine combusts fuel to generate power.

Hereinafter, a hydraulic system of a construction machine adopting a mechanical hydraulic pump will be described with reference to accompanying FIG. 1.

FIG. 1 is a diagram for describing a hydraulic system for a construction machine.

A mechanical hydraulic pump 10 includes a swash plate r, and a discharged flow rate is controlled to be increased and decreased according to an inclination angle of the swash plate. The inclination angle of the swash plate is adjusted by a pump regulator 40.

Operation oil discharged from the hydraulic pump 10 is provided to a main control valve 20, and when a specific spool is operated in the main control valve 20, the aforementioned operation oil is provided to an actuator 30 connected to the corresponding spool. The actuator 30 receiving the operation oil is operated to perform a desired operation.

In the meantime, a worker generates a flow rate control signal by operating a joystick, a pedal, and the like. The flow control signal moves a specific spool in the main control valve 20 according to a flow rate control signal line pi.

That is, when the worker operates the joystick, the flow rate control signal operates the spool of the main control valve 20 to open/close the spool, and when the corresponding spool is opened, the operation oil is provided to the actuator 30, so that the actuator 30 performs a desired operation.

In the meantime, the hydraulic pump 10 receives power from an engine 100. The engine 100 is controlled under control of an engine control device 104.

Further, revolutions per minute (rpm) of the engine 100 may be set by an engine rpm controller 102 in advance, and the rpm may be changed by a command of a pump control device 50.

When the command of the rpm is input to the engine control device 104, the engine control device 104 operates an engine governor 106 to make fuel be provided to the engine 100. For example, when the command for increasing the rpm is given, the amount of injection fuel is increased, when the command for decreasing the rpm is given, the amount of injection fuel is decreased, and when a specific rpm is desired to be maintained, the amount of injection fuel is constantly maintained.

In the meantime, a gear pump 70, which is an auxiliary pump, is further provided in the hydraulic pump 10. The gear pump 70 provides pilot operation oil to the joystick, the pedal, and the like, and generates a flow rate control signal when the worker operates the joystick and the pedal to transmit a pressure of the flow rate control signal.

In the meantime, a first hydraulic line L1 is connected so that the pilot operation oil discharged from the gear pump 70 passes through an electronic proportional pressure reducing valve 60 to be connected to a shuttle valve 80. One side of the shuttle valve 80 receives a flow rate control signal pi. The shuttle valve 80 selects a larger pressure between a pressure of the first hydraulic line L1 and the pressure of the flow rate control signal line, and provides the selected pressure to a pump regulator 40 through a second hydraulic line L2.

The aforementioned electronic proportional pressure reducing valve 60 receives a control signal from the aforementioned pump control device 50 through a first signal line s1. Particularly, when an optional operation (ex. a breaker/shear) is performed in the construction machine, a higher pressure is output by comparing the pilot pressure of the flow rate control signal line pi with a pressure corresponding to a flow rate set for the optional operation by using the electronic proportional pressure reducing valve 60 to control the flow rate.

Hereinafter, the pump regulator 40 for controlling the hydraulic pump 10 will be described with reference to FIGS. 1 and 2.

FIG. 2 is a diagram for describing a control of the mechanical hydraulic pump in the hydraulic system of the construction machine.

The control of the mechanical hydraulic pump 10 includes a flow control, a constant horse power control, and a power shift control, and will be described in detail based on each control.

[Flow Control]

The flow control generates a demanded flow rate by operating the joystick, and the flow rate control signal pi corresponding to displacement of an operation of the joystick is generated by the flow control. For example, when the flow rate control signal pi is increased from p1 to p2 as illustrated in FIG. 2A, the pump regulator 40 controls a flow rate Qp to be increased from q1 to q2 by adjusting the swash plate r. Accordingly, a discharged flow rate of the hydraulic pump 10 is increased.

[Constant Horse Power Control]

The constant Horse power control controls a constant pump horse power, which is set by receiving a load pressure Pd, to be maintained.

In the constant horse power control, a correlation between the pressure and the flow rate is set as a P-Q map, and the discharged flow rate is changed according to the P-Q map set by receiving the pressure load Pd applied to a hydraulic line between the hydraulic pump 10 and the main control valve 20.

For example, when the load pressure Pd is increased from p1 to p2 as illustrated in FIG. 2B, the pump regulator 40 controls the flow rate Qp to be decreased from q1 to q2 by adjusting the swash plate r. Accordingly, the discharged flow rate of the hydraulic pump 10 is controlled to be decreased, but the pump horse power is constantly maintained.

[Power Shift Control]

The power shift control is a control of adjusting a pump horse power according to a load state of the engine. That is, a plurality of P-Q maps is set in the constant horse power control, and a P-Q map is selected from the plurality of P-Q maps according to a load to control the hydraulic pump. The plurality of P-Q maps receives a command from the pump control device 50 through a second signal line s2.

For example, as illustrated in FIG. 2C, the plurality of P-Q maps may be provided as a heavy load map, a standard load map, and a light load map, and the hydraulic pump is controlled by selecting a specific P-Q map according to a load.

Accordingly, even though the same load pressure Pd is applied, when the heavy load map is selected, a large flow rate corresponding to q1 is discharged. However, when the standard load map is selected, a flow rate corresponding to q2, which is smaller than q1, is discharged. Further, when the light load map is selected, a flow rate corresponding to q3, which is smaller than q2, is discharged.

That is, according to the power shift control, when it is determined that a load of an operation target is large, the P-Q map close to a heavy load is selected, when it is determined that the load of the operation target is general, the standard load map is selected, and when it is determined that the load of the operation target is small, the P-Q map close to a light load is selected, thereby controlling the hydraulic pump 10.

The hydraulic system in the related art, which is configured and operated as described above has problems below.

When the joystick is suddenly operated, so that a large flow rate is suddenly and instantaneously demanded, the hydraulic system becomes temporarily unstable, which will be described with reference to FIGS. 3 and 4.

FIG. 3 is a diagram for describing a change in a flow rate in the constant horse power control in the hydraulic system of the construction machine in the related art. FIG. 4 is a diagram for describing a change in a pump discharged flow rate, a change in an rpm of an engine, and a change in an output of the engine by an operation of the joystick in the hydraulic system of the construction machine in the related art.

As illustrated in FIG. 3, when the pump load pressure Pd is suddenly increased, the flow rate is suddenly increased so as to respond to the sudden increase of the load pressure Pd. However, a capacity of the hydraulic pump 10 is physically limited, so that there is a case where when an excessive flow rate is demanded, the demanded flow rate exceeds a range handled by the hydraulic pump 10, and in this case, the flow rate is controlled to be gradually decreased by the constant horse power control.

That is, the pump load pressure is maintained at the low pressure p1 at an initial stage and the small flow rate q1 is discharged, and when the demanded flow rate is suddenly increased, the flow rate Qp is suddenly increased in comparison with a change in the pump load pressure Pd, so that the flow rate Qp is increased to a maximum flow rate q2, and then, the flow rate is controlled to be decreased by the constant horse power control and thus the decreased flow rate Qp is discharged. Then, the flow rate is stabilized from a stabilization time point t2 while maintaining the high pump load pressure Pd.

As described above, when the joystick is suddenly operated, as illustrated in FIG. 4A, as can be seen from the change in the pump discharged flow rate, a delta flow rate delta Qp is discharged until just before a maximum flow rate immediately after a joystick operation time point t1, and the flow rate is stabilized by the constant horse power control after a predetermined time elapses.

As described above, the excessive operation oil flow rate, which is discharged from a peak portion indicated by the delta flow rate Qp to the stabilization of the hydraulic pump due to the sudden increase in the flow rate generates a hydraulic impact, thereby making the hydraulic system be unstable.

Further, as illustrated in FIG. 4B, investigating a change in the rpm of the engine, large power is instantaneously demanded, but the rpm of the engine is not immediately reflected due to a mechanical dynamic property, and the rpm of the engine is sharply decreased, so that a delta rpm is also decreased. Then, after a speed of a turbo charger is increased and fuel is appropriately injected, the rpm of the engine reaches a target rpm.

That is, in the hydraulic system using the mechanical hydraulic pump 10 in the related art, there is a problem in that when the demanded flow rate is sharply increased, the rpm of the engine is sharply decreased or the engine is stalled.

Further, even when the engine is stalled or the rpm of the engine is sharply decreased as described above, fuel is continuously supplied, thereby degrading fuel efficiency.

The decrease phenomenon of the rpm of the engine will be additionally described with reference to FIG. 4C.

When the demanded flow rate is increased, the hydraulic pump 10 requires larger power, so that the rpm of the engine 100 is increased. However, it is impossible to immediately implement a desired rpm due to the mechanical dynamic property. The reason is that an engine governing section is required until the rpm of the engine is increased. Particularly, a turbo charger time lack section is present in the engine governing section because a predetermined time is inevitably consumed until the turbo charger is rotated from a low speed to a high speed. Accordingly, when the demanded flow rate is suddenly increased, the rpm of the engine is increased within an allowed range of the output of the engine, and is delayed until the turbo charger is normally operated, and the rpm of the engine is increased when the turbo charger normally performs the function.

In the meantime, in a construction machine including the mechanical hydraulic pump in the related art, a rotation speed of the engine is decreased by a hydraulic load when an initial operation is performed, and a controller detects the decrease in the rotation speed of the engine to decrease a pump load through a power shift control (pump power shift control) so as to prevent the rotation speed of the engine from being decreased.

However, the power shift control does not have a method of decreasing a flow rate control of determining a flow rate discharged by a joystick lever or a driving lever, so that there is a problem in that when an initial operation or a sudden operation is performed, the rpm of the engine is decreased.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, a technical object to be achieved in the present disclosure is to provide a hydraulic system of a construction machine adopting a mechanical hydraulic pump, which controls a discharged flow rate discharged from a hydraulic pump to be smoothly increased even though a demanded flow rate is suddenly increased, thereby preventing a hydraulic impact.

Another object of the present disclosure is to provide a hydraulic system of a construction machine adopting a mechanical hydraulic pump, which prevents an rpm of an engine from being sharply decreased when a demanded flow rate is suddenly increased, thereby improving fuel efficiency.

A technical object to be achieved in the present disclosure is not limited to the aforementioned technical objects, and other not-mentioned technical objects will be obviously understood from the description below by those with ordinary skill in the art to which the present disclosure pertains.

In order to achieve the above object, the present disclosure provides a hydraulic system of a construction machine, including: an electronic proportional pressure reducing valve (EPPRV) 60 configured to control a flow rate, to which maximum pressure is input as a control current value, and which is set to a minimum flow rate; a gear pump 70 configured to provide pilot operation oil to the EPPRV 60; a shuttle valve 80 configured to compare a pressure of first pilot operation oil passing through the EPPRV 60 and a pressure of a flow rate control signal, and output second pilot operation oil having the greater pressure; a hydraulic pump 10 of which a swash plate angle is controlled by the second pilot operation oil; and a pump control device 50 configured to control a pressure of the EPPRV 60 to be decreased from the maximum pressure by a predetermined inclination when the flow rate control signal is generated.

In the hydraulic system of the construction machine according to the present disclosure, a plurality of pressures of the flow rate control signal may be input by first and second flow rate control signal lines pi-1 and pi-2, the shuttle valve 80 may include a first shuttle valve 81 configured to compare a first pressure of the first flow rate control signal line pi-1 and the first pilot pressure and output the greater pressure as third pilot operation oil, and a second shuttle valve 82 configured to compare a second pressure of the second flow rate control signal line pi-2 and the first pilot pressure, and output the greater pressure as fourth pilot operation oil, and the hydraulic pump 10 includes a first hydraulic pump 11 of which a swash plate angle is controlled by the third pilot operation oil, and a second hydraulic pump 12 of which a swash plate angle is controlled by the fourth pilot operation oil.

In the hydraulic system of the construction machine according to the present disclosure, when the flow rate control signal is not generated, the pump control device 50 may control the maximum pressure to be input as the control current value, and setting of the minimum flow rate to be returned.

Other detailed matters of the exemplary embodiments are included in the detailed description and the drawings.

In the hydraulic system of the construction machine adopting the mechanical hydraulic pump according to the present disclosure configured as described above, it is possible to control a flow rate discharged from the hydraulic pump to be smoothly increased by controlling the hydraulic pump so as to decrease pressure from a maximum pressure by a predetermined inclination by the electronic proportional pressure reducing valve even though a demanded flow rate is suddenly increased, thereby preventing a hydraulic impact.

Further, in the hydraulic system of the construction machine adopting the mechanical hydraulic pump according to the present disclosure, it is possible to prevent a load of the engine from being suddenly increased by smoothly increasing pump input horse power, thereby preventing an rpm of the engine from being sharply decreased, and improving fuel efficiency.

A technical object to be achieved in the present disclosure is not limited to the aforementioned technical objects, and another not-mentioned technical object will be obviously understood from the description below by those with ordinary skill in the art to which the present disclosure pertains.

Figure 1:
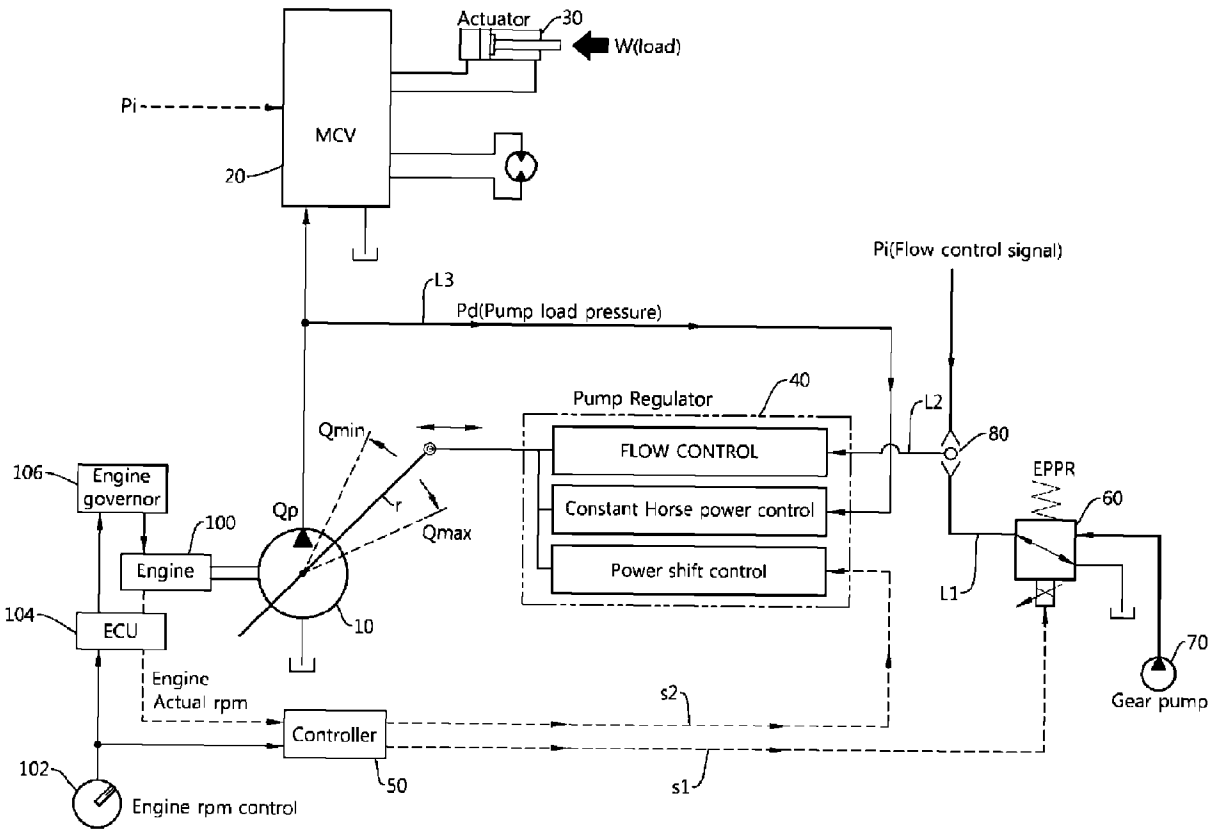
FIG. 1 is a diagram for describing a hydraulic system for a construction machine.
Figure 2:
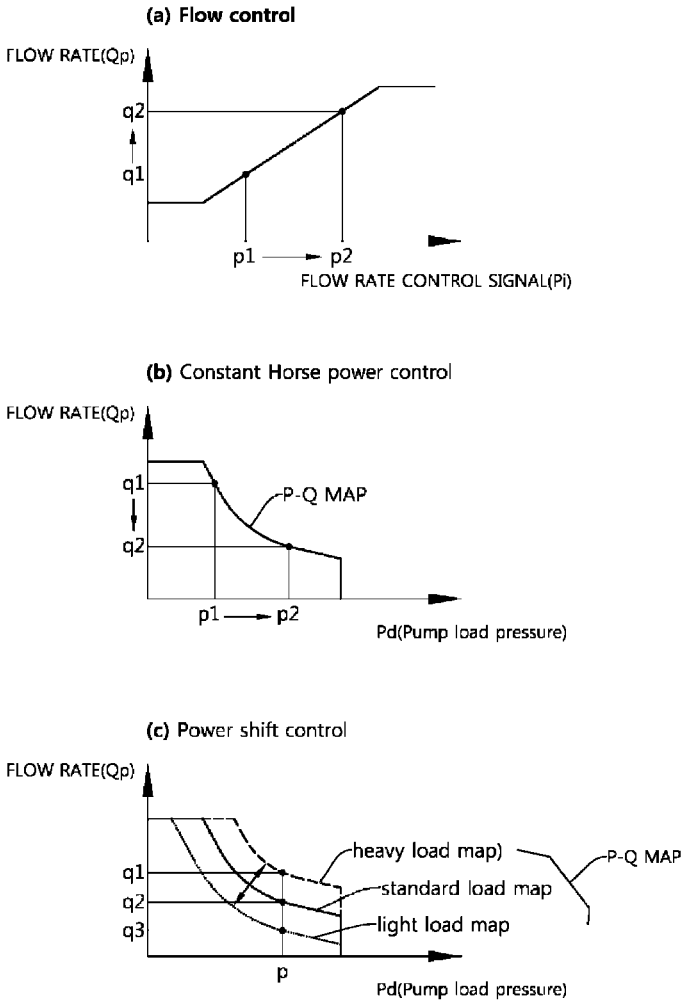
FIG. 2 is a diagram for describing a control of a mechanical hydraulic pump in the hydraulic system of the construction machine.
Figure 3:
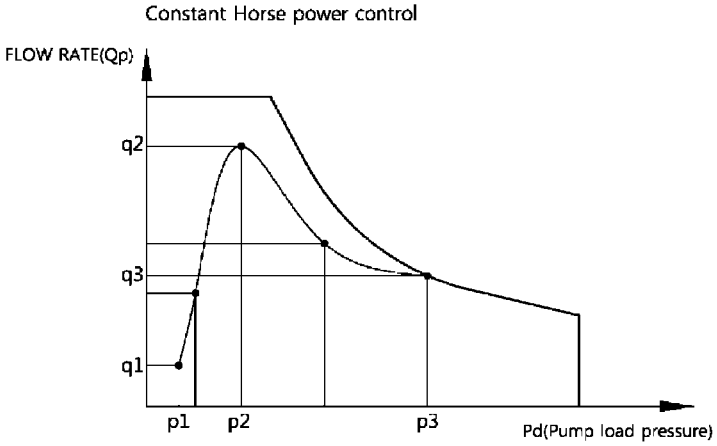
FIG. 3 is a diagram for describing a change in a flow rate in a constant horse power control in the hydraulic system of the construction machine in the related art.
Figure 4:
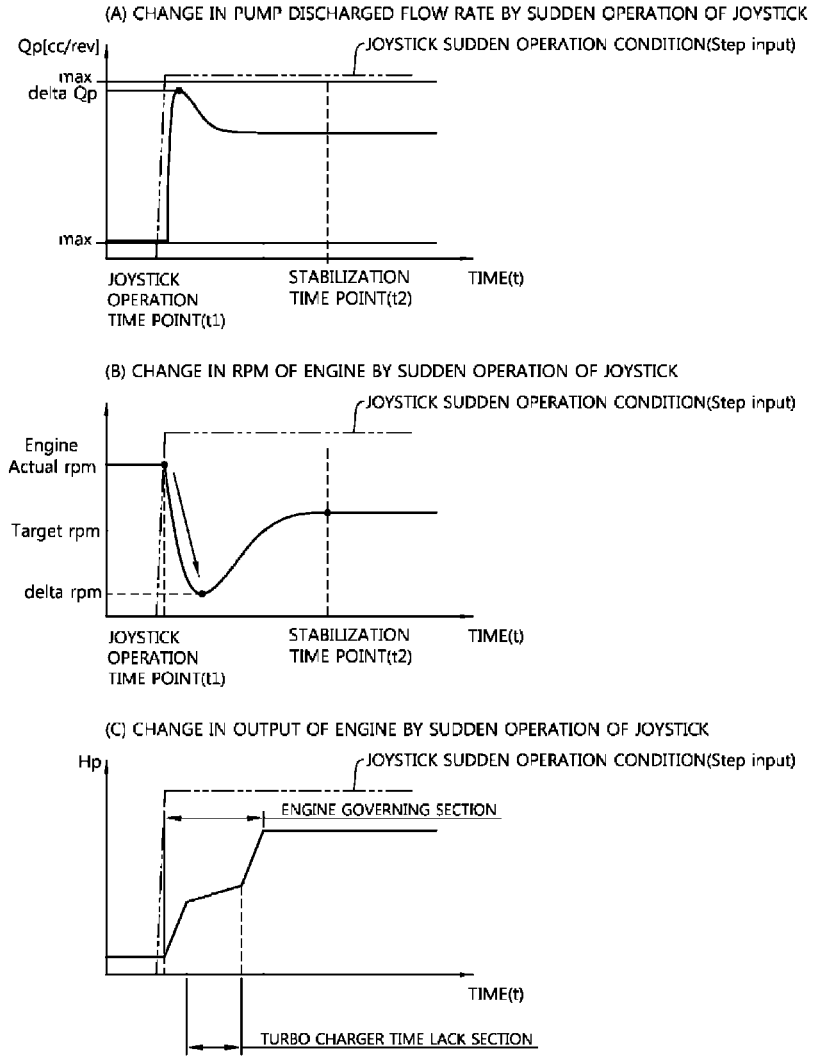
FIG. 4 is a diagram for describing a change in a pump discharged flow rate, a change in an rpm of an engine, and a change in an output of the engine by an operation of a joystick in the hydraulic system of the construction machine in the related art.

| Description of Main Reference Numerals of Drawings | |
|---|---|
| 10: Hydraulic pump | 11, 12: First and second hydraulic pumps |
| 20: Main control valve (MCV) | 30: Actuator |
| 40, 40a: Pump regulator | 50: Pump control device |
| 60: Electronic proportional pressure reducing valve (EPPR) | |
| 70: Gear pump | |
| 80: Shuttle valve | 81, 82: First and second shuttle valves |
| 100: Engine | |
| 104: Engine control unit (ECU) | 102: Engine rpm controller |
| L1~L5: First to fifth hydraulic lines | 106: Engine governor |
| s1~s2: First and second signal lines | |
| pi: Flow rate control signal line | |
| pi-1, pi-2: First and second flow rate control signal lines | |
| r: Swash plate | r1, r2: First, second swash plate |

DETAILED DESCRIPTION

Advantages and characteristics of the present disclosure, and a method of achieving the advantages and characteristics will be clear with reference to an exemplary embodiment described in detail together with the accompanying drawings.

Throughout the specification, the same reference numeral denotes the same constituent element, and the same reference numeral is assigned to the same constituent element as that of the related art, and thus a repeated description will be omitted.

In the meantime, the terms used in the description below are defined considering the functions of the present disclosure, and may vary depending on the intention or usual practice of a manufacturer, so that the definitions thereof should be made based on the entire contents of the present specification.

Hereinafter, a hydraulic system of a construction machine according to an exemplary embodiment of the present disclosure will be described with reference to FIG. 5.

Figure 5:
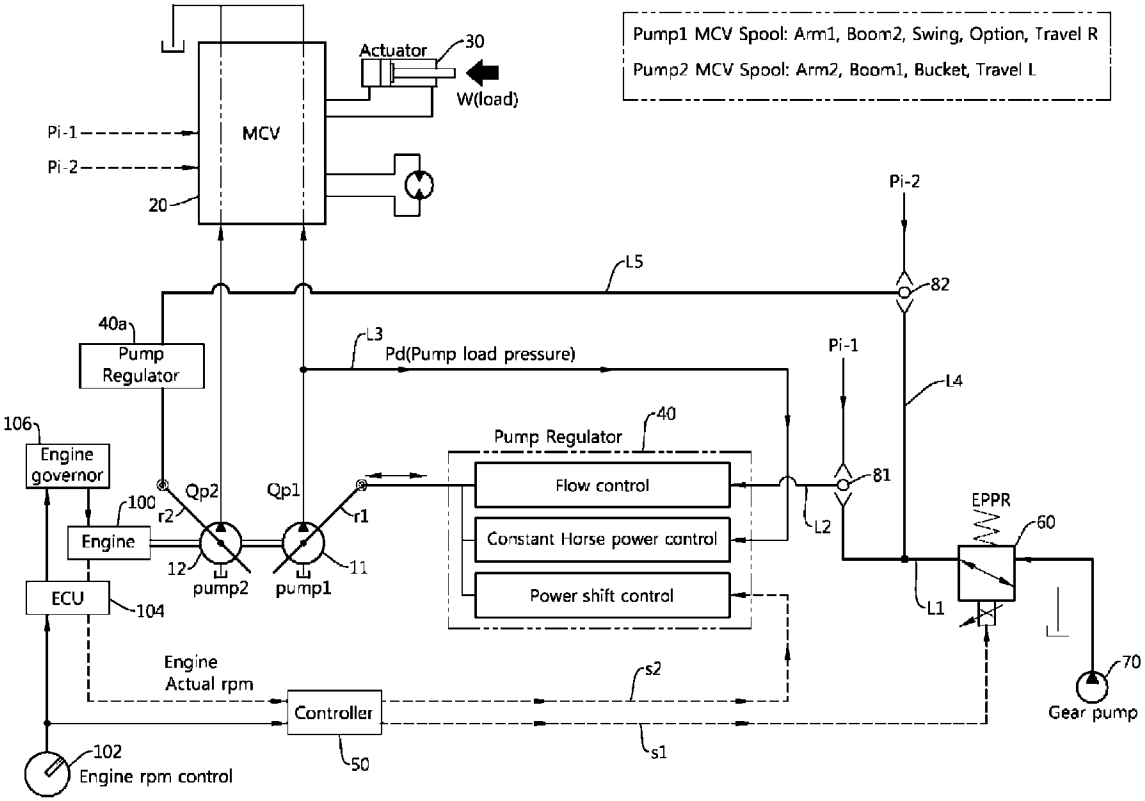
FIG. 5 is a diagram for describing a hydraulic system of a construction machine according to an exemplary embodiment of the present disclosure.

FIG. 5 is a diagram for describing a hydraulic system of a construction machine according to an exemplary embodiment of the present disclosure.

A hydraulic pump 10 includes a first hydraulic pump 11 and a second hydraulic pump 12. The first and second hydraulic pumps 11 and 12 become first and second swash plates r1 and r2, respectively.

A plurality of spools is provided inside a main control valve 20. More particularly, the main control valve 20 includes a first spool group handled by the first hydraulic pump 11, and a second spool group handled by the second hydraulic pump 12.

The first spool group includes an arm 1 spool, a boom 2 spool, a swing spool, an option spool, and a right travel motor (Travel R) spool.

The second spool group includes an arm 2 spool, a boom 1 spool, a bucket spool, and a left travel motor (Travel L) spool.

Further, two joysticks may be provided, and pilot pressures for operating a specific spool among the plurality of spools is formed by operating the joysticks in a left-right direction and a front-rear direction, respectively. Each of the pilot pressures is provided to the main control valve 20 through first and second flow rate control signal lines pi-1 and pi-2.

In the meantime, a gear pump 70 is provided at one side of the first and second hydraulic pumps 11 and 12. A first hydraulic line L1 is provided so that pilot operation oil discharged from the gear pump 70 passes through an electronic proportional pressure reducing valve 60 to be connected to a first shuttle valve 81. One side of the first shuttle valve 81 is connected to the first flow rate control signal pi-1 to receive a first pressure.

The first shuttle valve 81 selects a larger pressure between a first pilot operation oil pressure of the first hydraulic line L1 and the first pressure of the first flow rate control signal, and provides the selected pressure to a pump regulator 40 through a second hydraulic line L2. The pump regulator 40 controls a swash plate angle of the first hydraulic pump 11. Similarly, the second shuttle valve 82 selects a larger pressure between a first pilot operation oil pressure of the first and fourth hydraulic lines L1 and L4 and a second pressure of the second flow rate control signal, and provides the selected pressure to a pump regulator 40*a* through a fifth hydraulic line L5. The pump regulator 40*a* controls a swash plate angle of the second hydraulic pump 12.

Further, the pilot operation oil discharged from the gear pump 70 passes through the electronic proportional pressure reducing valve 60 to become first pilot operation oil, and the fourth hydraulic line L4 is connected to the second shuttle valve 82. One side of the second shuttle valve 82 is connected to the second flow rate control signal line pi-2 to receive a second pressure. In the meantime, the first hydraulic line L1 and the fourth hydraulic line L4 are provided to be connected so that the pilot operation oil bilaterally flows.

The second shuttle valve 82 selects a larger pressure between the first pilot operation oil pressure of the fourth hydraulic line L4 and the second pressure of the second flow rate control signal line pi-2, and makes the selected pressure pass through the second hydraulic line L2 and control the swash plate of the second hydraulic pump 12.

That is, the pilot operation oil discharged from the gear pump 70 is provided to the first and second shuttle valves 81 and 82 in an opened state of the electronic proportional pressure reducing valve 60 to control the swash plate angles of the first and second hydraulic pumps 11 and 10.

In the meantime, the electronic proportional pressure reducing valve (EPPRV) 60 for the flow rate control is set so that a maximum pressure is input to the EPPRV 60 as a control current value, and a flow rate is set to a minimum flow rate to be maintained.

Further, in the hydraulic system according to the exemplary embodiment of the present disclosure, there is no input from the joystick in an idle state, in which an operation device of the construction machine does not move, so that a maximum pressure is input as a pressure of a foot relief valve.

The EPPRV 60 is used for controlling an optional flow rate in a general situation, and in a case where an optional operation is not performed, the flow rate control signal is not generated, so that the EPPRV 60 may return to an initial state to be used for controlling an operation flow rate. That is, the EPPRV 60 described in the present disclosure may be used when the flow rate control for the first and second hydraulic pumps 11 and 12 is performed by operating the joystick.

Particularly, when an optional operation (ex. a breaker/shear) is performed, a flow rate control signal Pi of the hydraulic pump, which is not used for the optional operation, is high (for example, a negative control), so that the discharged flow rate is minimum and thus the optional operation may be performed.

Further, when an operation other than the optional operation is performed, a pressure corresponding to pressures of the flow rate control signals Pi, pi-1, and pi-2 is set as the current of the EPPRV 60 in an idle state, so that when the actuator 30 is operated, an inclination of the EPPRV 60 may be appropriately adjusted in accordance with the sharply decreased pressures of the flow rate control signals Pi, pi-1, and pi-2 to prevent a rotation speed of the engine from being decreased.

Hereinafter, an operation of the hydraulic system of the construction machine according to the present disclosure will be described with reference to FIGS. 6 to 10.

Figure 6:
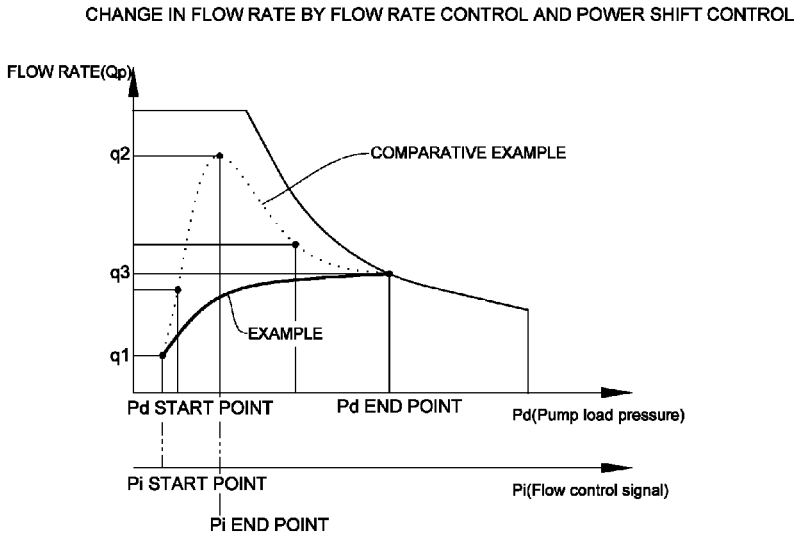
FIG. 6 is a diagram for describing a change in a flow rate by a flow rate control and a power shift control in the hydraulic system of the construction machine according to the exemplary embodiment of the present disclosure.

FIG. 6 is a diagram for describing a change in a flow rate by a flow rate control and a power shift control in the hydraulic system of the construction machine according to the exemplary embodiment of the present disclosure.

As illustrated in FIG. 6, in a Comparative Example, an excessive flow rate is discharged by a response delay of the pump regulators 40 and 40*a* before the pump flow rate reaches the stabilization by the constant horse power control.

That is, in the Comparative Example of the related art, the flow rate is sharply increased (q1→q2) from a time point (Pi start point), at which the joystick is operated, to a time point (Pi end point), at which the operation of the joystick is ended, by the flow rate control. Then, the power shift control reacts with a time difference due to the response delay to decrease the flow rate to a flow rate q3 so that the belatedly increased pump load is maintained at an end point of the pump load pressure (Pd end point).

As described above, in the Comparative Example of the related art, the excessive flow rate discharge generated when the joystick is sharply operated may not be controlled, and further, the horse power consumed by the pump is increased according to the excessive flow rate increase, so that the load of the engine is increased, and thus the pump power shift control is performed by the control of the target rpm to decrease the flow rate of the pump, thereby causing deterioration in equipment performance.

However, the hydraulic system according to the present disclosure may promptly increase the load of the pump by promptly operating the pump regulators 40 and 40*a* with the pilot operation oil flowing from the gear pump 70, and thus the power shift control prevents the flow rate from being excessively discharged at the initial stage, thereby smoothly implementing an increase tendency of the flow rate.

Particularly, when the joystick is operated, the pressure of the flow control signal is sharply increased from the time point (Pi start point), at which the joystick is operated, to the time point (Pi end point) at which the operation of the joystick is ended, and the hydraulic system according to the present disclosure decreases the pressure from the maximum pressure by a predetermined inclination by using the EPPRV 60 for the flow rate control, thereby controlling the discharged flow rate to be smoothly increased.

Accordingly, the hydraulic system according to the present disclosure may adjust a rate of the pump horse power increase by the excessive discharged flow rate, and may be minimally influenced by the pump power shift control according to the load of the engine, which is the problem in the hydraulic system in the related art, thereby preventing equipment performance from deteriorating and being advantageous to operate the equipment.

Further, the excessive discharged flow rate of the first and second hydraulic pumps 11 and 12 is controlled, so that an equipment impact is decreased, and the discharged flow rate is smoothly increased, thereby improving general controllability when a joystick is operated.

Figure 7:
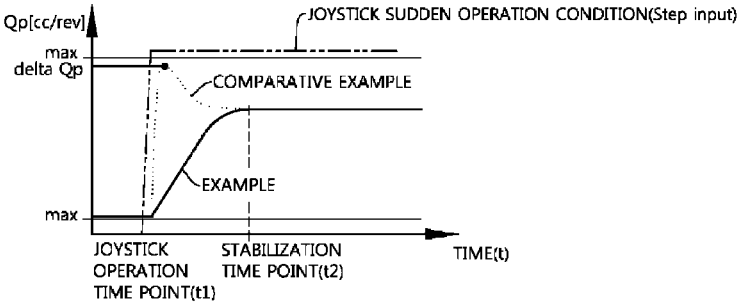
FIG. 7 is a diagram for describing a change in a pump discharged flow rate by an operation of a joystick in the hydraulic system of the construction machine according to the exemplary embodiment of the present disclosure.

A change in a pump discharged flow rate will be described with reference to FIG. 7. FIG. 7 is a diagram for describing a change in a pump discharged flow rate by an operation of the joystick in the hydraulic system of the construction machine according to the exemplary embodiment of the present disclosure.

As illustrated in FIG. 7, in the Comparative Example, when the joystick is suddenly operated, the flow rate is sharply increased just after a time point t1, at which the joystick is operated, so that a delta flow rate Qp is excessively discharged, and the flow rate is stabilized from a stabilization time point t2 after a predetermined time elapses.

However, in the hydraulic system according to the present disclosure, even though the joystick is suddenly operated, the pressure may be decreased from the maximum pressure by the predetermined inclination by the EPPRV 60 as described above, thereby controlling the discharged flow rate to be smoothly increased.

Figure 8:
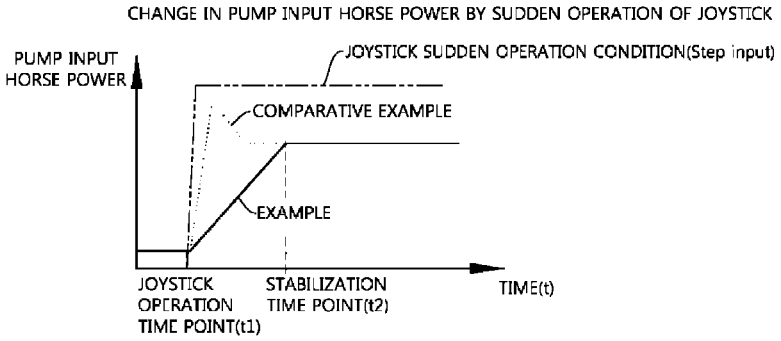
FIG. 8 is a diagram for describing a change in pump input horse power by an operation of the joystick in the hydraulic system of the construction machine according to the exemplary embodiment of the present disclosure.

Hereinafter, a change in pump input horse power will be described with reference to FIG. 8. FIG. 8 is a diagram for describing a change in pump input horse power by an operation of the joystick in the hydraulic system of the construction machine according to the exemplary embodiment of the present disclosure.

As illustrated in FIG. 8, in the Comparative Example, when the joystick is suddenly operated, pump input horse power is sharply increased just after the time point t1, at which the joystick is operated, to form a peak, and then the pump input horse power is decreased, so that the pump input horse power is stabilized from a stabilization time point t2 after a predetermined time elapses.

However, in the hydraulic system according to the present disclosure, even though the joystick is suddenly operated, the pressure may be decreased from the maximum pressure by the predetermined inclination by the EPPRV 60 as described above, thereby controlling the pump input horse power to be smoothly increased by a predetermined inclination.

Figure 9:
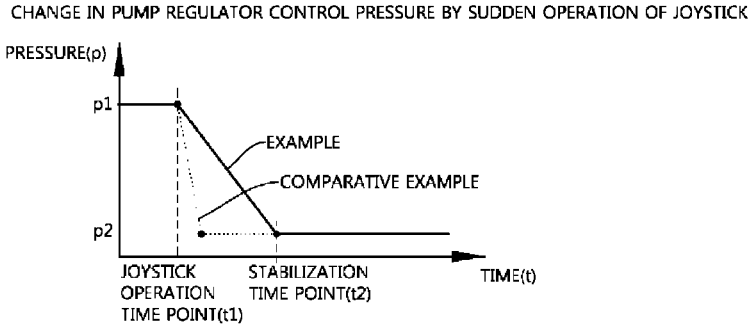
FIG. 9 is a diagram for describing a change in a pump regulator control pressure of a discharged hydraulic pressure by an operation of the joystick in the hydraulic system of the construction machine according to the exemplary embodiment of the present disclosure.

Hereinafter, a change in a discharged hydraulic pressure will be described with reference to FIG. 9. FIG. 9 is a diagram for describing a change in a pump regulator control pressure of a discharged hydraulic pressure by an operation of the joystick in the hydraulic system of the construction machine according to the exemplary embodiment of the present disclosure.

As illustrated in FIG. 9, a pump regulator control pressure is a pressure applied to the first and fifth hydraulic lines L2 and L5, and a pressure for substantially controlling the first and second swash plates r1 and r2 of the first and second hydraulic pumps.

As illustrated in FIG. 9, in the Comparative Example, when the joystick is suddenly operated, the pump regulator control pressure is sharply decreased just after the time point t1 at which the joystick is operated. Then, the pump regulator control pressure is stabilized from the stabilization time point t2 after a predetermined time elapses.

However, in the hydraulic system according to the present disclosure, even though the joystick is suddenly operated, the pressure may be decreased from the maximum pressure by the predetermined inclination by the EPPRV 60 as described above, thereby controlling the pump input horse power to be smoothly decreased at a predetermined inclination.

Figure 10:
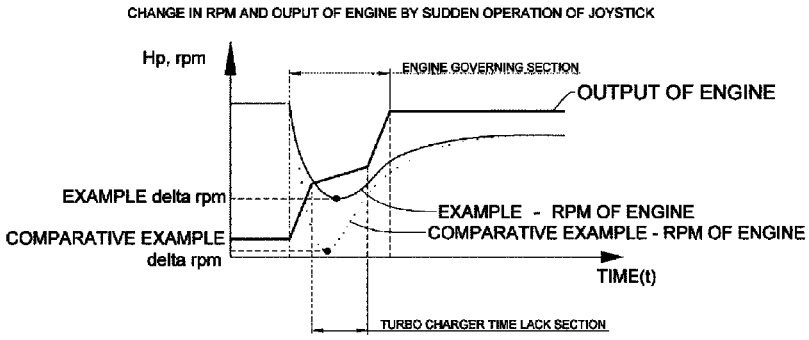
FIG. 10 is a diagram for describing a change in an rpm of the engine and a change in an output of the engine by an operation of the joystick in the hydraulic system of the construction machine according to the exemplary embodiment of the present disclosure.

Hereinafter, a change in a characteristic of the engine will be described with reference to FIG. 10. FIG. 10 is a diagram for describing a change in an rpm of the engine and a change in an output of the engine by an operation of the joystick in the hydraulic system of the construction machine according to the exemplary embodiment of the present disclosure.

As illustrated in FIG. 10, when the demanded flow rate is increased, or the high horse power is demanded, the rpm of the engine is increased. However, in order to increase the rpm of the engine to the target rpm of the engine to implement a desired output of the engine, a predetermined time is required.

That is, an engine governing section is essentially required to increase the rpm of the engine, and a time, at which the turbo charger normally performs a function, is included in the engine governing section. When the turbo charger does not normally perform the normal function, a high rpm of the engine may not be expected.

The Comparative Example represents a change trend of the rpm of the engine in the hydraulic system in the related art, and the load of the pump is sharply increased just after the joystick is suddenly operated, so that the rpm of the engine is sharply decreased at a large level (see the delta rpm of the Comparative Example).

When the rpm of the engine reaches the desired target rpm after the time of the engine governing section elapses, the rpm is gradually stabilized.

However, in the hydraulic system according to the exemplary embodiment of the present disclosure, the load of the pump applied to the pump is gradually increased, so that even though the rpm of the engine is decreased, the rpm of the engine is decreased at a relatively small level in comparison with that of the Comparative Example (see the delta rpm of the Example).

That is, the pump power shift control according to the load of the engine is minimally applied, so that it is possible to prevent equipment performance from deteriorating, which is advantageous to operate equipment of the construction machine.

Further, the rpm of the engine reaches the desired target rpm while the time of the engine governing section elapses after the rpm of the engine is decreased, and the decrease level of the rpm of the engine is small, so that the rpm of the engine may more promptly reach the desired target rpm to be stabilized.

In the hydraulic system of the construction machine adopting the mechanical hydraulic pump according to the present disclosure, which is configured as described above, it is possible to control the flow rate discharged from the hydraulic pump to be smoothly increased by controlling the hydraulic pump so as to decrease a pressure from a maximum pressure by a predetermined inclination by the electronic proportional pressure reducing valve even though a demanded flow rate is sharply increased, thereby preventing a hydraulic impact.

Further, in the hydraulic system of the construction machine adopting the mechanical hydraulic pump according to the present disclosure, it is possible to prevent a load of the engine from being sharply increased by smoothly increasing pump input horse power, thereby preventing an rpm of the engine from being sharply decreased, and improving fuel efficiency.

The exemplary embodiments of the present disclosure have been described with reference to the accompanying drawings, but those skilled in the art will understand that the present disclosure may be implemented in another specific form without changing the technical spirit or an essential feature thereof.

Accordingly, it will be understood that the aforementioned exemplary embodiments are described for illustration in all aspects and are not limited, and it will be construed that the scope of the present disclosure of the detailed description is represented by the claims to be described below, and all of the changes or modified forms induced from the meaning and the scope of the claims, and an equivalent concept thereof are included in the scope of the present disclosure.

The hydraulic system of the construction machine according to the present disclosure may be used for decreasing fuel consumption when a joystick is suddenly operated and improving manipulability in the hydraulic system adopting a mechanical hydraulic pump.

Although the present disclosure has been described with reference to exemplary and preferred embodiments, workers skilled in the art will recognize that changes may be made in form and detail without departing from the spirit and scope of the disclosure.

The invention claimed is:

1. A hydraulic system of a construction machine, comprising:

an electronic proportional pressure reducing valve (EPPRV) configured to control a flow rate, to which a maximum pressure is input as a control current value, and which is set to a minimum flow rate;

a gear pump configured to provide pilot operation oil to the EPPRV;

a shuttle valve configured to compare a pressure of first pilot operation oil passing through the EPPRV and a pressure of a flow rate control signal, and output second pilot operation oil having the greater pressure;

a hydraulic pump of which a swash plate angle is controlled by the second pilot operation oil; and a pump control device configured to control the pressure of first pilot operation oil to be decreased from a maximum pressure by a predetermined inclination when the flow rate control signal is generated.

2. The hydraulic system of claim 1, wherein a plurality of pressures of the flow rate control signal is input by first and second flow rate control signal lines, the shuttle valve includes a first shuttle valve configured to compare a first pressure of the first flow rate control signal line and the first pilot operation oil pressure and output the greater pressure as third pilot operation oil, and a second shuttle valve configured to compare a second pressure of the second flow rate control signal line and the first pilot operation oil pressure, and output the greater pressure as fourth pilot operation oil and the hydraulic pump includes a first hydraulic pump of which a swash plate angle is controlled by the third pilot operation oil, and a second hydraulic pump of which a swash plate angle is controlled by the fourth pilot operation oil.

3. The hydraulic system of claim 1, wherein when the flow rate control signal is not generated, the pump control device controls the maximum pressure to be input as the control current value, and setting of the minimum flow rate to be returned.

* * * * *